US008711006B2

(12) United States Patent
Yoo et al.

(10) Patent No.: US 8,711,006 B2
(45) Date of Patent: Apr. 29, 2014

(54) VEHICLE DETECTION APPARATUS AND METHOD USING MAGNETIC SENSOR

(75) Inventors: Jae-Jun Yoo, Daejeon (KR); Do-Hyun Kim, Daejeon (KR); Jong-Hyun Park, Daejeon (KR); Kyong-Ho Kim, Daejeon (KR); Jong-Woo Choi, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 50 days.

(21) Appl. No.: 13/601,370

(22) Filed: Aug. 31, 2012

(65) Prior Publication Data

US 2013/0154855 A1 Jun. 20, 2013

(30) Foreign Application Priority Data

Dec. 14, 2011 (KR) ..... 10-2011-0134833

(51) Int. Cl.
*G08G 1/042* (2006.01)
*G08G 1/01* (2006.01)

(52) U.S. Cl.
USPC ..... 340/933; 340/910; 340/941; 701/117

(58) Field of Classification Search
CPC ..... G08G 1/01; G08G 1/042; G08G 1/052; G08G 1/056
USPC ..... 340/910, 933, 935, 936, 939, 941; 701/117, 119, 530, 538
See application file for complete search history.

(56) References Cited

U.S. PATENT DOCUMENTS

| | | | | | |
|---|---|---|---|---|---|
| 4,953,305 | A * | 9/1990 | Van Lente et al. | ..... | 33/356 |
| 5,737,226 | A * | 4/1998 | Olson et al. | ..... | 701/530 |
| 5,987,374 | A * | 11/1999 | Akutsu et al. | ..... | 701/117 |
| 6,192,315 | B1 * | 2/2001 | Geschke et al. | ..... | 701/530 |
| 6,781,523 | B2 * | 8/2004 | Matsui et al. | ..... | 340/910 |
| 7,388,517 | B2 | 6/2008 | Kavaler | | |
| 8,417,441 | B2 * | 4/2013 | Kavaler et al. | ..... | 701/117 |
| 2010/0134322 | A1 | 6/2010 | Yoo et al. | | |

FOREIGN PATENT DOCUMENTS

| | | | |
|---|---|---|---|
| KR | 10-2003-0092970 | A | 12/2003 |
| KR | 10-2010-0062844 | A | 6/2010 |
| KR | 10-2011-0081636 | A | 7/2011 |

* cited by examiner

*Primary Examiner* — Van T. Trieu
(74) *Attorney, Agent, or Firm* — Rabin & Berdo, P.C.

(57) ABSTRACT

The vehicle detection apparatus includes a communication unit, a magnetic sensing unit, a calibration information generation unit, a vehicle detection unit, and a control unit. The communication unit receives information about movement of a reference vehicle from a central management center. The magnetic sensing unit senses the change in a magnetic field attributable to the movement of a vehicle, and generates a magnetic signal. The calibration information generation unit generates calibration information. The vehicle detection unit calibrates the change in the magnetic signal attributable to movement of an actual vehicle based on the calibration information, and detects the movement of the actual vehicle. The control unit controls the above units, and sets the mode to calibration information generation mode in order to generate the calibration information and to vehicle detection mode in order to sense the movement of the actual vehicle.

14 Claims, 5 Drawing Sheets

VEHICLE DETECTION APPARATUS AND METHOD USING MAGNETIC SENSOR

CROSS REFERENCE TO RELATED APPLICATION

This application claims the benefit of Korean Patent Application No. 10-2011-0134833, filed on Dec. 14, 2011, which is hereby incorporated by reference in its entirety into this application.

BACKGROUND OF THE INVENTION

1. Technical Field

The present invention relates generally to a vehicle detection apparatus and method using a magnetic sensor and, more particularly, to a vehicle detection apparatus and method using a magnetic sensor, which measure the change in a magnetic signal for a vehicle to be tested, record measurement results in advance, and calibrate a change in a magnetic signal for an actual vehicle while referring to the recorded results, thereby increasing the accuracy of the determination of the presence and movement of a vehicle.

2. Description of the Related Art

In order to detect the presence and movement of a vehicle and calculate the speed of the vehicle, various vehicle detection technologies have been proposed up to the present, and these technologies use a loop type detector, an image detector, a laser sensor, and an ultrasonic sensor.

Vehicle detection technologies for detecting the presence and movement of a vehicle include a vehicle detection method using a conventional magnetic sensor disclosed in U.S. Pat. No. 7,388,517. U.S. Pat. No. 7,388,517 discloses a method for detecting a change in the earth's magnetic field attributable to the movement of a vehicle, and extracting information about the presence and movement of the vehicle based on the change in the earth's magnetic field. This method proposes various algorithms for processing a magnetic signal in order to detect a vehicle using a magnetic sensor.

However, the conventional vehicle detection method using a magnetic sensor in order to detect a vehicle has a problem in that it is difficult to set the reference of a magnetic signal used to determine the detection of a vehicle because the intensity of the earth's magnetic field varies depending on the location where a magnetic sensor is installed.

Therefore, it is necessary to calibrate a magnetic signal obtained by a magnetic sensor in order to accurately detect a vehicle. However, a system and method capable of calibrating a magnetic signal obtained based on the presence and movement of a vehicle has not yet been provided.

SUMMARY OF THE INVENTION

Accordingly, the present invention has been made keeping in mind the above problems occurring in the prior art, and an object of the present invention is to provide a vehicle detection technology using a magnetic sensor, which is capable of taking into consideration the intensity of the earth's magnetic field which varies depending on the location where a magnetic sensor is installed, thereby accurately determining the presence and movement of a vehicle based on detected changes in the magnetic field.

In order to accomplish the above object, the present invention provides a vehicle detection apparatus using a magnetic sensor, including a communication unit for receiving information about movement of a reference vehicle from a central management center; a magnetic sensing unit for sensing a change in a magnetic field attributable to the movement of a vehicle, and generating a magnetic signal based on the change in the magnetic field; a calibration information generation unit for generating calibration information by recording the information about the movement of the reference vehicle, which is received by the communication unit, and the change in the magnetic signal attributable to the movement of the reference vehicle, the magnetic signal being generated by the magnetic sensing unit; a vehicle detection unit for calibrating the change in the magnetic signal attributable to movement of an actual vehicle, the magnetic signal being generated by the magnetic sensing unit, based on the calibration information generated by the calibration information generation unit, and detecting the movement of the actual vehicle by analyzing the calibrated change in the magnetic signal; and a control unit for controlling the communication unit, the calibration information generation unit and the vehicle detection unit, and setting a mode to calibration information generation mode in order to generate the calibration information and to vehicle detection mode in order to sense the movement of the actual vehicle.

Here, when the mode is set to the calibration information generation mode, the control unit may transmit a reference vehicle movement request signal, used to request that the reference vehicle move, to the central management center via the communication unit.

Here, when the change in the magnetic signal cannot be detected based on the movement of the reference vehicle, the control unit may transmit a reference vehicle re-movement request signal, used to request that the reference vehicle remove, to the central management center via the communication unit.

Here, when the mode is set to vehicle detection mode and the vehicle detection unit detects the movement of the actual vehicle, the control unit may transmit a vehicle detection signal to the central management center via the communication unit.

Here, the information about the movement of the reference vehicle may include any one of an ID of the reference vehicle, a speed of the reference vehicle, a travelling direction of the reference vehicle, whether the reference vehicle stops in the movement or not, and a time span of the movement of the reference vehicle.

Here, the vehicle detection unit may perform calibration by performing filtering and size adjustment on the magnetic signal in such a way as to compare the change in the magnetic signal attributable to the movement of the actual vehicle with the change in the magnetic signal attributable to the movement of the reference vehicle, the change in the magnetic signal being included in the calibration information.

Here, the vehicle detection apparatus using a magnetic sensor may further include a calibration information storage unit for storing the calibration information generated by the calibration information generation unit.

In order to accomplish the above object, the present invention provides a vehicle detection method using a magnetic sensor, including detecting a change in a magnetic signal attributable to movement of a reference vehicle using a magnetic sensing unit; receiving information about the movement of the reference vehicle from a central management center using a communication unit; generating calibration information by recording the information about the movement of the reference vehicle and the change in the magnetic signal attributable to the movement of the reference vehicle using a calibration information generation unit; measuring a change in a magnetic signal attributable to movement of an actual vehicle using the magnetic sensing unit; calibrating the change in the magnetic signal attributable to the movement of the actual vehicle based on the calibration information using a vehicle detection unit; and detecting the movement of the actual vehicle by analyzing the calibrated change in the magnetic signal.

Here, the vehicle detection method using a magnetic sensor may further include, before the detecting the change in the magnetic signal attributable to the movement of the reference vehicle using the magnetic sensing unit, transmitting a reference vehicle movement request signal, used to request that the reference vehicle move, to the central management center via the communication unit.

Here, the vehicle detection method using a magnetic sensor may further include, before receiving the information about the movement of the reference vehicle from the central management center using the communication unit, transmitting a reference vehicle re-movement request signal, used to request that the reference vehicle re-move, to the central management center via the communication unit when the change in the magnetic signal attributable to the movement of the reference vehicle cannot be detected.

Here, the vehicle detection method using a magnetic sensor may further include transmitting a vehicle detection signal to the central management center via the communication unit when the movement of the actual vehicle is detected.

Here, the information about the movement of the reference vehicle may include any one of an ID of the reference vehicle, a speed of the reference vehicle, a travelling direction of the reference vehicle, whether the reference vehicle stops in the movement or not, and a time span of the movement of the reference vehicle.

Here, in the vehicle detection method using a magnetic sensor, the calibrating the change in the magnetic signal based on the movement of the actual vehicle may include performing calibration by performing filtering and size adjustment on the magnetic signal in such a way as to compare the change in the magnetic signal attributable to the movement of the actual vehicle with the change in the magnetic signal attributable to the movement of the reference vehicle, the change in the magnetic signal being included in the calibration information.

Here, the vehicle detection method using a magnetic sensor may further include storing the calibration information after generating the calibration information.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
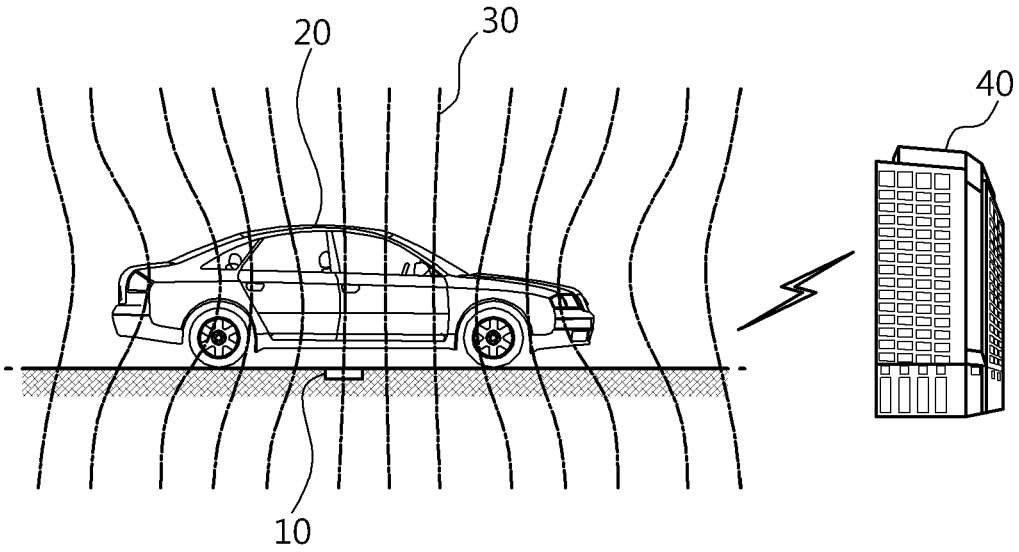
FIG. 1 is a view schematically illustrating the concept of a vehicle detection method using a magnetic sensor according to the present invention.

The present invention will be described in detail with reference to the accompanying drawings below. Here, when the description is repetitive and detailed descriptions of well-known functions or configurations would unnecessarily obscure the gist of the present invention, they will be omitted. The embodiments of the present invention are provided to complete the explanation for those skilled in the art of the present invention. Therefore, the shapes and sizes of components in the drawings may be exaggerated to provide a more precise description In accordance with a vehicle detection apparatus and method using a magnetic sensor according to the present invention, a magnetic sensor is installed on a road, a vehicle to be tested (hereinafter referred to as a "reference vehicle") is made to move over the magnetic sensor installed on the surface of the road before a change in the earth's magnetic field is sensed and the movement of an actual vehicle is detected, a change in a magnetic signal attributable to the movement of the reference vehicle is recorded and stored, and the latter change in the magnetic signal is used as information (hereinafter, "calibration information") which is used to calibrate a changing magnetic signal when the actual vehicle moves. Therefore, when the presence and movement of the actual vehicle is detected, the degree of the change in a magnetic signal which is generated based on the movement of the vehicle can be exactly determined in spite of the various types of intensity of the earth's magnetic field in different regions where magnetic sensors are installed. The collection of calibration information using a vehicle to be tested can be performed several times on reference vehicles which have various characteristics (sizes and shapes) or a reference magnetic objects which are similar to the reference vehicles.

FIG. 1 is a view schematically illustrating the concept of a vehicle detection method using a magnetic sensor according to the present invention.

Referring to FIG. 1, a vehicle detection apparatus 10 using a magnetic sensor according to the present invention is placed and installed in the road on which a vehicle moves, and determines the presence and movement of a vehicle 20 by detecting a change in the earth's magnetic field 30 attributable to the movement of the vehicle 20. Here, when the vehicle detection apparatus 10 detects the presence and movement of the vehicle 20, the vehicle detection apparatus 10 transmits a vehicle detection signal to a central management center 40 in a wireless communication manner in order to provide notification that the presence and movement of the vehicle 20 was detected.

Here, after the vehicle detection apparatus 10 using a magnetic sensor according to the present invention has been initially installed in the road, calibration information, which is used as reference information used to calibrate the change in a magnetic signal attributable to the movement of an actual vehicle, is obtained and stored before the detection of the actual vehicle is performed. For this purpose, the vehicle detection apparatus 10 causes a reference vehicle (including a reference magnetic object) to move on the road in which the vehicle detection apparatus 10 has been installed, measures a change in a magnetic signal, and then receives information about the movement of the corresponding reference vehicle from the central management center 40 in a wireless communication manner. The above-described process is performed several times while the characteristics (size and shape) and movement methods (speed, travelling direction, stopping or not, and time span) of the reference vehicle are being changed. If all the trial movements performed by the reference vehicles are completed, a specific reference vehicle is matched with information about the movement of the specific reference vehicle, and then the resulting information is recorded, thereby generating and storing calibration information.

Thereafter, if, when an actual vehicle is detected using the vehicle detection apparatus 10 using a magnetic sensor according to the present invention, the earth's magnetic field due to the movement of the actual vehicle is changed and therefore a change in a magnetic signal is detected, information about the change in the magnetic signal obtained for the actual vehicle is calibrated by performing filtering and size adjustment while referring to information about the change in the magnetic signal for the reference vehicle included in the calibration information which has been stored in advance, and the presence and movement of the actual vehicle is determined by analyzing the calibrated information about the change in the magnetic signal.

Figure 2:
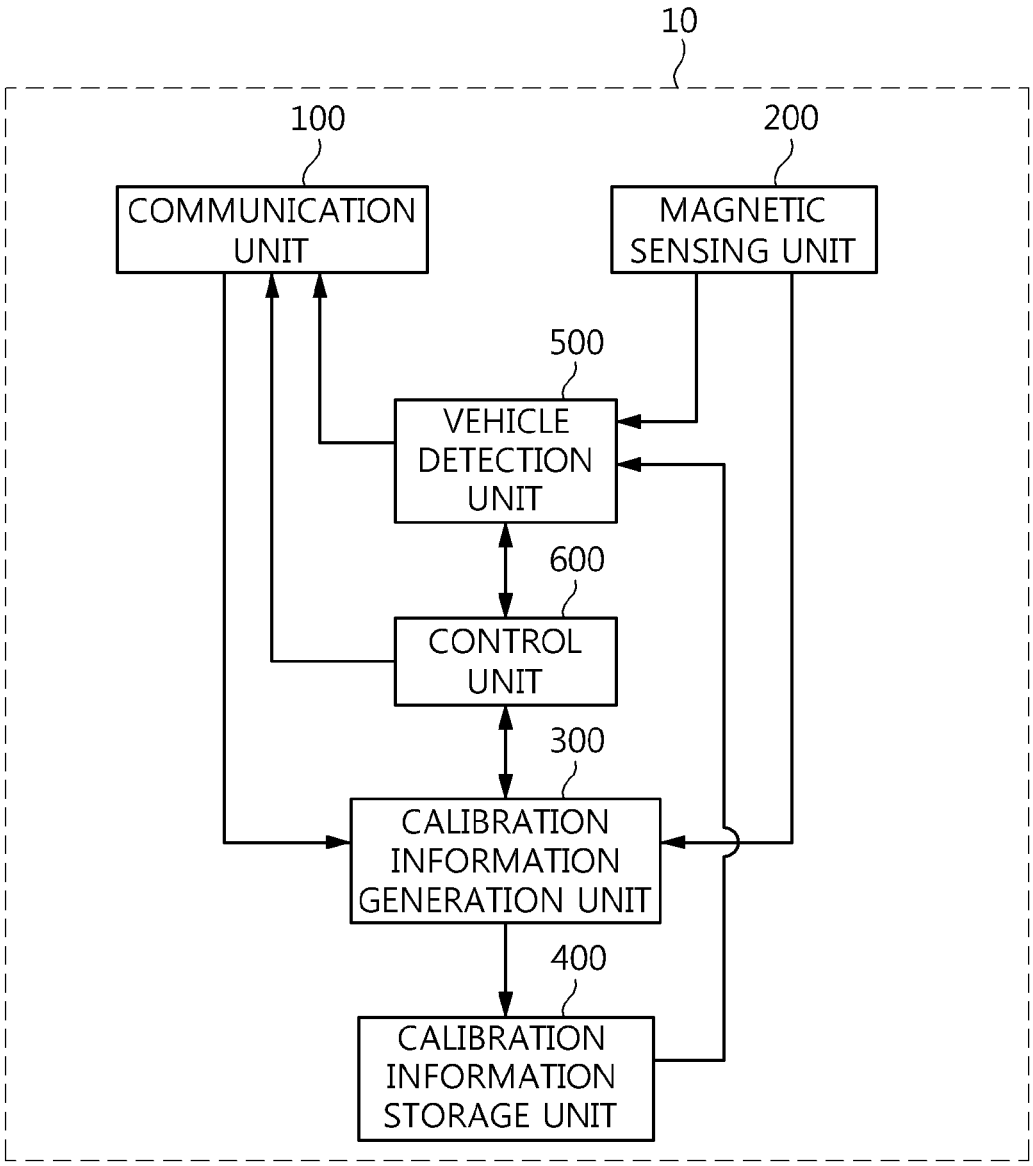
FIG. 2 is a view illustrating the configuration of a vehicle detection apparatus using a magnetic sensor according to the present invention.

FIG. 2 is a view illustrating the configuration of the vehicle detection apparatus 10 using a magnetic sensor according to the present invention.

Referring to FIG. 2, the vehicle detection apparatus 10 using a magnetic sensor according to the present invention includes a communication unit 100 for transmitting and receiving a signal to and from the central management center 40 in a wireless communication manner, a magnetic sensing unit 200 for detecting a change in the earth's magnetic field which occurs on the surface of the road and generating information about a change in a magnetic signal, a calibration information generation unit 300 for generating calibration information by recording information about a change in the magnetic signal attributable to the movement of a reference vehicle, the information being generated by the magnetic sensing unit 200, and information about the movement of the corresponding reference vehicle, the information being received from the central management center 40 via the communication unit 100, a calibration information storage unit 400 for storing the calibration information generated by the calibration information generation unit 300, a vehicle detection unit 500 for detecting information about the presence and movement of an actual vehicle by analyzing the information about a change in a magnetic signal attributable to the movement of an actual vehicle, which is generated by the magnetic sensing unit 200, and a control unit 600 for controlling the operation of the units included in the vehicle detection apparatus 10.

When the control unit 600 sets a mode to a calibration information generation mode in order to generate calibration information by measuring a change in a magnetic signal for the reference vehicle, the communication unit 100 transmits a reference vehicle movement request signal, used to request that the reference vehicle move on the road in which the vehicle detection apparatus 10 has been placed, to the central management center 40 under the control of the control unit 600. Further, when the central management center 40, which has received the request for the movement of the reference vehicle, makes the reference vehicle to move on the road in which the vehicle detection apparatus 10 has been placed but the change in the earth's magnetic field is not sensed by the magnetic sensing unit 200, the communication unit 100 transmits a reference vehicle re-movement request signal, used to request that the corresponding reference vehicle be moved again, to the central management center 40. Meanwhile, if a change in the earth's magnetic field attributable to the movement or re-movement of the reference vehicle has been successfully sensed, the communication unit 100 receives information about the movement of the corresponding reference vehicle from the central management center 40, and transmits the information about the movement of the corresponding reference vehicle to the calibration information generation unit 300. Here, the information about the movement of the corresponding reference vehicle may include the ID of the reference vehicle, the speed of the reference vehicle, the travelling direction of the reference vehicle, whether the reference vehicle stops in the movement or not, and the time span of the movement of the reference vehicle. Further, when the control unit 600 determines that it is necessary to additionally move the reference vehicle in order to generate sufficient calibration information, the communication unit 100 transmits an additional measurement signal, used to request that the reference vehicle be additionally moved on the road in which the vehicle detection apparatus 10 has been placed, to the central management center 40 under the control of the control unit 600. When the control unit 600 sets the mode to a vehicle detection mode, used to detect the movement of an actual vehicle by measuring a change in a magnetic signal for the actual vehicle, and the vehicle detection unit 500 detects the presence and movement of the actual vehicle, the communication unit 100 transmits a vehicle detection signal, used to provide notification that the presence and movement of the actual vehicle is detected, to the central management center 40.

Figure 3:
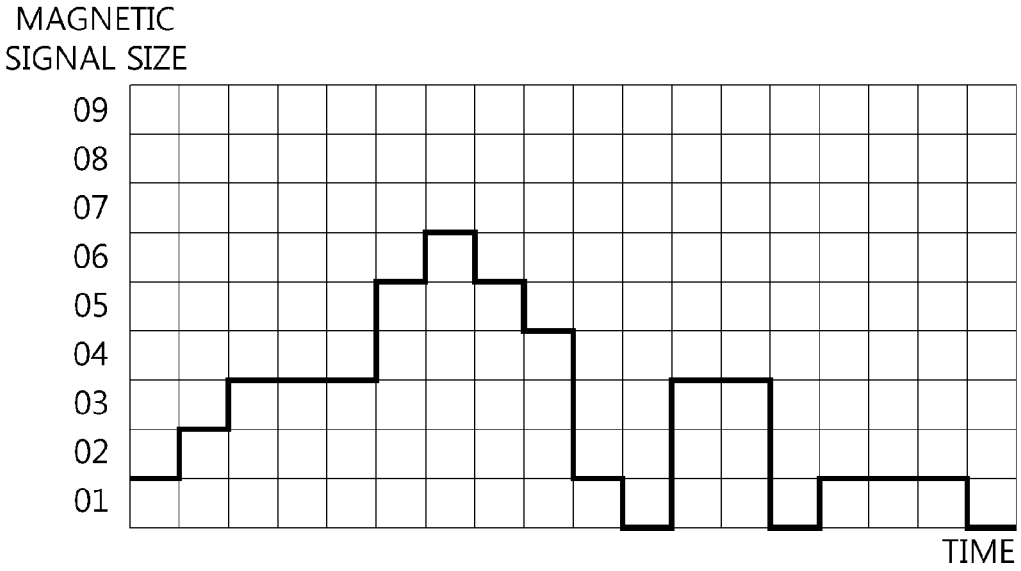
FIG. 3 is a view illustrating a magnetic signal generated by the magnetic sensing unit of the vehicle detection apparatus using a magnetic sensor according to the present invention.

When the reference vehicle moves on the road in which the vehicle detection apparatus 10 has been placed in calibration information generation mode, the magnetic sensing unit 200 senses a change in the earth's magnetic field attributable to the movement of the reference vehicle, generates a magnetic signal, and transmits the magnetic signal to the calibration information generation unit 300. Further, when the actual vehicle moves on the road in which the vehicle detection apparatus 10 has been placed in vehicle detection mode, the magnetic sensing unit 200 senses the change in the earth's magnetic field attributable to the movement of the actual vehicle, generates a magnetic signal, and transmits the magnetic signal to the vehicle detection unit 500. In accordance with an embodiment of the present invention, the magnetic sensing unit 200 includes a terrestrial magnetic sensor which reacts to the magnetic flux density of the peripheral earth magnetic field and outputs a magnetic signal illustrated in FIG. 3 by way of example. The terrestrial magnetism sensor which is used in a navigation system such as an electric compass or an airplane to detect a location and direction. Since the principle and movement of the terrestrial magnetism sensor correspond to those of a well-known technology, the description thereof will be omitted.

The calibration information generation unit 300 generates the calibration information by matching the change in the magnetic signal, which was generated by the magnetic sensing unit 200 based on the movement of the reference vehicle when the reference vehicle is moved or re-moved in calibration information generation mode, with the information about the movement of the corresponding reference vehicle, which was received from the central management center 40 by the communication unit 100, and then recording the resulting information. The calibration information generated by the calibration information generation unit 300 can be expressed as in the following Table 1:

TABLE 1

| Reference vehicle ID | Speed of motion (km/h) | Travelling direction (°) | Stopping or not | Movement time span | Change in magnetic signal |
|---|---|---|---|---|---|
| 1 | 18 | 0 (forward) | yes | morning | 01, 02, 04, 04, 05, 06, 05, 04, 01, 00, . . . |

TABLE 1-continued

| Reference vehicle ID | Speed of motion (km/h) | Travelling direction (°) | Stopping or not | Movement time span | Change in magnetic signal |
|---|---|---|---|---|---|
| 2 | 25 | 180 (backward) | no | afternoon | 01, 02, 02, 03, 08, 07, 08, 07, 04, 03, 06, . . . |
| . . . | . . . | . . . | . . . | . . . | . . . |
| . . . | . . . | . . . | . . . | . . . | . . . |

The calibration information storage unit 400 stores the calibration information generated by the calibration information generation unit 300, and provides the calibration information to the vehicle detection unit 500 in vehicle detection mode.

The vehicle detection unit 500 determines the presence and movement of the actual vehicle by analyzing the information about the change in the magnetic signal generated by the magnetic sensing unit 200 in vehicle detection mode. Here, the vehicle detection unit 500 performs calibration by performing filtering and size adjustment on the magnetic signal in such a way as to compare the information about the change in the magnetic signal generated by the magnetic sensing unit 200 with the calibration information stored in the calibration information storage unit 400. Further, the vehicle detection unit 500 determines the presence and movement of the actual vehicle by analyzing the calibrated information about the change in the magnetic signal. Here, the presence and movement of the actual vehicle can be determined by the vehicle detection unit 500 using, for example, a method of comparing a magnetic signal, which is generated by the magnetic sensing unit 200 depending on the presence and movement of a vehicle, with a predetermined reference value which is set in advance, and considering a vehicle to be present when the magnetic signal is above or below the corresponding reference value. However, the determination is not limited thereto.

After the vehicle detection apparatus 10 has been placed and installed in the road on which a vehicle moves, the control unit 600 can set the mode to calibration information generation mode in order to generate calibration information based on the movement of the reference vehicle before the actual vehicle is sensed or to vehicle detection mode in order to sense the presence and movement of the actual vehicle. When the control unit 600 sets the mode to calibration information generation mode, the control unit 600 transmits a reference vehicle movement request signal, used to request that the reference vehicle move on the road in which the vehicle detection apparatus 10 has been placed, to the central management center 40 via the communication unit 100. Further, when the central management center 40, which has received the requested for the movement of the reference vehicle, moves the reference vehicle on the road in which the vehicle detection apparatus 10 has been placed, the control unit 600 determines whether a change in the earth's magnetic field is sensed by the magnetic sensing unit 200. If the change in the earth's magnetic field is not sensed by the magnetic sensing unit 200, the control unit 600 transmits a reference vehicle re-movement request signal, used to request the re-movement of the corresponding reference vehicle, to the central management center 40 via the communication unit 100. Meanwhile, since the characteristics (size and shape) and movement method of actual vehicles are different from each other, there are various pieces of information about the change in a magnetic signal attributable to the movement of the actual vehicles. Therefore, calibration information, which is referred to when calibration is performed on the magnetic signal, should be sufficiently generated. For this purpose, a process of sensing the movement of the reference vehicle and the change in the earth's magnetic field attributable to the movement of the reference vehicle is performed several times while changing the characteristics and movement methods of the reference vehicle. Therefore, the control unit 600 determines whether it is necessary to additionally move the reference vehicle such that the calibration information generation unit 300 can generate sufficient pieces of calibration information. If it is determined that it is necessary to additionally move the reference vehicle, the control unit 600 transmits the additional measurement signal, used to request that the reference vehicle additionally move on the road in which the vehicle detection apparatus 10 has been placed, to the central management center 40 via the communication unit 100. Further, when the control unit 600 sets the mode to vehicle detection mode and the vehicle detection unit 500 detects the presence and movement of the actual vehicle, the control unit 600 transmits the vehicle detection signal, used to provide notification that the presence and movement of the vehicle is detected, to the central management center 40 via the communication unit 100.

A vehicle detection method using a magnetic sensor according to the present invention will be described with reference to FIGS. 4 and 5 below. The descriptions which are the same as those of the operation of the vehicle detection apparatus using a magnetic sensor according to the present invention described with reference to FIG. 2 will be omitted.

Figure 4:
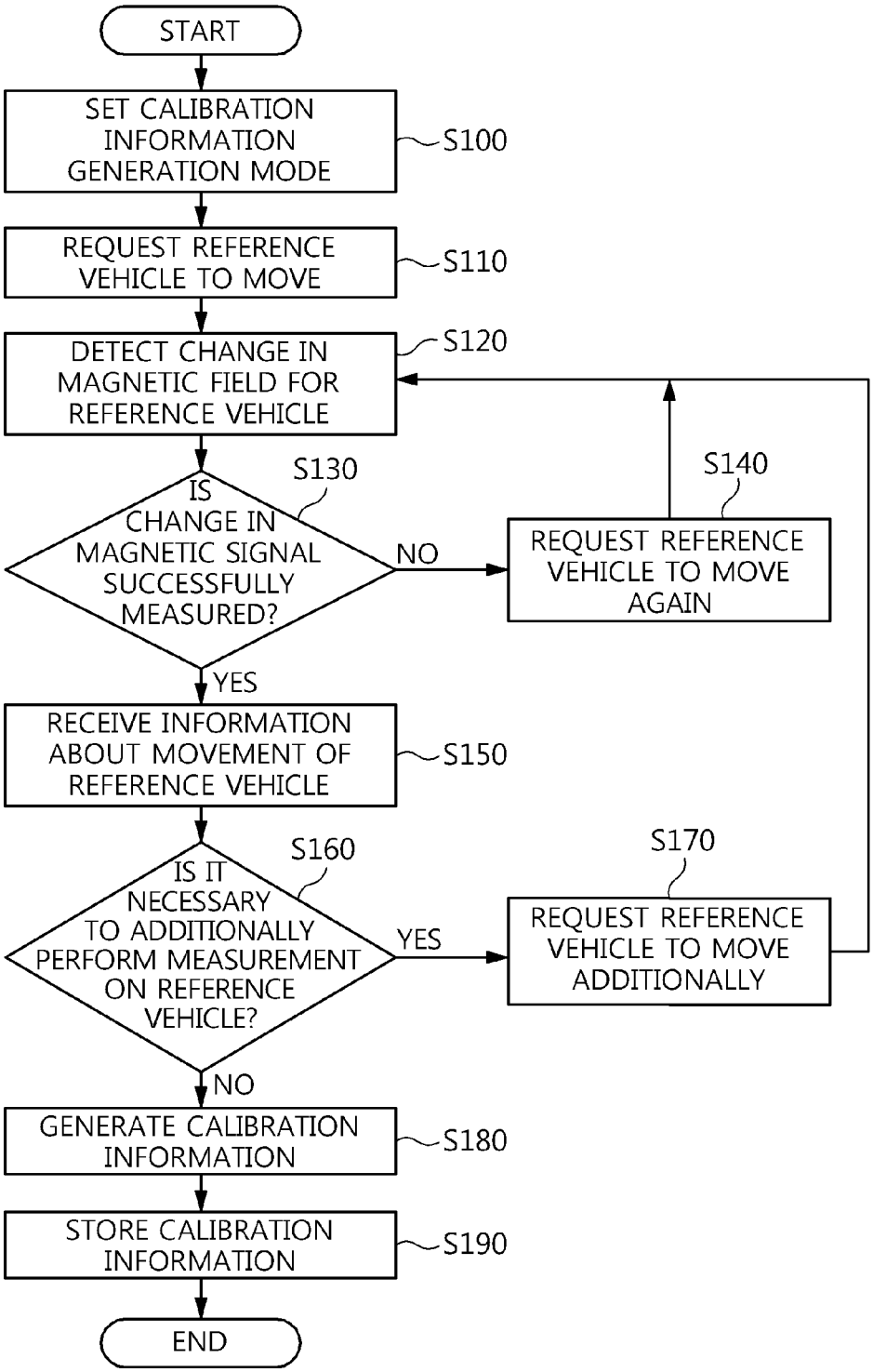
FIGS. 4 and 5 are flowcharts illustrating the vehicle detection method using a magnetic sensor according to the present invention.

FIG. 4 is a flowchart illustrating a process of generating the calibration information based on the movement of the reference vehicle in the vehicle detection method using a magnetic sensor according to the present invention.

In the vehicle detection method using a magnetic sensor according to the present invention, after the vehicle detection apparatus 10 has been placed in the road on which a vehicle moves, a process of generating calibration information based on the movement of the reference vehicle is performed before the detection of an actual vehicle is performed. Referring to FIG. 4, in the process of generating the calibration information, the control unit 600 first sets the mode to calibration information generation mode at step S100, and transmits the reference vehicle movement request signal, used to request that the reference vehicle move on the road in which the vehicle detection apparatus 10 has been placed, to the central management center 40 via the communication unit 100 at step S110.

When the central management center 40 receives the reference vehicle movement request signal from the communication unit 100 and then moves the reference vehicle on the road in which the vehicle detection apparatus 10 has been placed, the magnetic sensing unit 200 detects a change in the earth's magnetic field attributable to the movement of the reference vehicle at step S120. Here, the magnetic sensing unit 200 transmits a magnetic signal, which is generated by sensing the change in the earth's magnetic field attributable to the movement of the reference vehicle, to the calibration information generation unit 300.

Thereafter, the control unit 600 determines whether a change in the magnetic signal has been successfully measured based on the magnetic signal generated by the magnetic sensing unit 200 at step S130.

If, as a result of the determination at step S130, it is determined that the measurement of the change in the magnetic signal for the reference vehicle has failed, the control unit 600 transmits the reference vehicle re-movement request signal, used to request that the corresponding reference vehicle move again on the road in which the vehicle detection apparatus 10 has been placed, to the central management center 40 via the communication unit 100 at step S140.

Meanwhile, if, as the result of the determination at step S130, it is determined that the measurement of the change in the magnetic signal has been successful for the reference vehicle, the control unit 600 controls the communication unit 100 such that information about the movement of the corresponding reference vehicle is received from the central management center 40 at step S150. Here, the communication unit 100 transmits the received information about the movement of the corresponding reference vehicle to the calibration information generation unit 300 such that the calibration information generation unit 300 uses the information about the movement of the corresponding reference vehicle to generate the calibration information.

Thereafter, the control unit 600 determines whether it is necessary to additionally measure the change in the magnetic signal by changing the method of moving the reference vehicle which has already been moved or it is necessary to additionally measure the change in the magnetic signal by moving another reference vehicle having characteristics different from those of the reference vehicle which has been already moved such that the calibration information generation unit 300 can generate sufficient pieces of calibration information at step S160. If, as a result of the determination at step S160, it is determined that it is necessary to additionally measure the change in the magnetic signal for the reference vehicle, the control unit 600 transmits the additional measurement signal, used to request that the reference vehicle additionally move on the road in which the vehicle detection apparatus 10 has been placed, to the central management center 40 via the communication unit 100 at step S170. Further, the control unit 600 repetitively performs steps S120 to S160 on the additional reference vehicle.

Meanwhile, if, as the result of the determination at step S160, it is determined that it is not necessary to measure the change in the magnetic signal for the reference vehicle anymore, the control unit 600 terminates the measurement of the magnetic signal for the reference vehicle, and the calibration information generation unit 300 generates calibration information by matching the change in the magnetic signal attributable to the movement of the reference vehicle, which was received from the magnetic sensing unit 200, with the information about the movement of the corresponding reference vehicle, which was received from the communication unit 100, and recording the resulting information at step S180.

Once the generation of the calibration information at step S180 has completed, the calibration information generation unit 300 stores the calibration information in the calibration information storage unit 400 at step S190.

Figure 5:
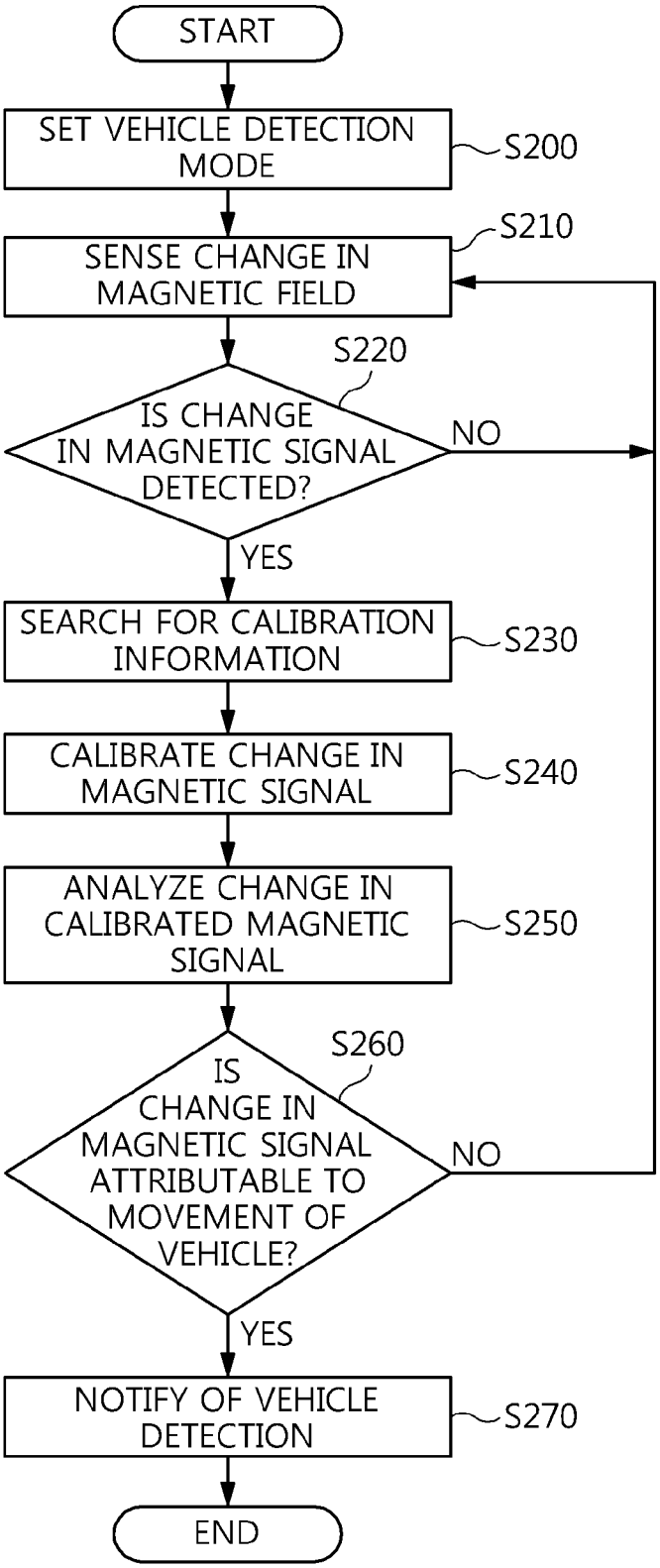

FIG. 5 is a flowchart illustrating a process of detecting the presence and movement of an actual vehicle in the vehicle detection method using a magnetic sensor according to the present invention In the vehicle detection method using a magnetic sensor according to the present invention, once the process of generating the calibration information described with reference to FIG. 4 has been completed, the process of detecting the presence and movement of an actual vehicle by measuring the change in a magnetic signal for the actual vehicle is performed. For this purpose, referring to FIG. 5, the control unit 600 first sets the mode to vehicle detection mode at step S200, and the magnetic sensing unit 200 senses the change in the magnetic field attributable to the movement of an actual vehicle in real time and generates a magnetic signal based on the change in the magnetic field at step S210. Here, the magnetic sensing unit 200 transmits the generated magnetic signal to the vehicle detection unit 500.

Thereafter, the control unit 600 determines whether a change in the magnetic signal attributable to the movement of the actual vehicle has been detected based on the magnetic signal generated by the magnetic sensing unit 200 at step S220. If, as a result of the determination at step S220, it is determined that a change in the magnetic signal has been detected, the vehicle detection unit 500 searches the calibration information storage unit 400 for the calibration information at step S230, performs calibration, such as filtering or size adjustment, on the information about the change in the magnetic signal received from the magnetic sensing unit 200 while referring to the found calibration information, and analyzes the information about the change in the calibrated magnetic signal at step S250.

Thereafter, the vehicle detection unit 500 determines, based on the results of the analysis of the information about the change in the magnetic signal at step S250, whether the change in the magnetic signal is attributable to the movement of the vehicle, at step S260.

If, as a result of the determination at step S260, it is determined that the change in the magnetic signal corresponds to the change in the magnetic signal attributable to the movement of the vehicle, the control unit 600 transmits the vehicle detection signal, used to provide notification that the presence and movement of the vehicle is detected, to the central management center 40 via the communication unit 100 at step S270.

In accordance with the present invention, the presence and movement of a vehicle is determined by calibrating information about a change in a sensing signal for an actual vehicle based on information about a change in a magnetic signal which is sensed for a vehicle to be tested, and analyzing the information about the change in the sensing signal, so that there is the advantage of increasing the accuracy of determination of the presence and movement of a vehicle even when magnetic sensors are installed in regions having different intensities regarding the earth's magnetic field.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vehicle detection apparatus using a magnetic sensor, comprising:

a communication unit for receiving information about movement of a reference vehicle from a central management center;

a magnetic sensing unit for sensing a change in a magnetic field attributable to movement of vehicles, and generating a magnetic signal based on the change in the magnetic field;

a calibration information generation unit for generating calibration information by using the information about the movement of the reference vehicle and the change in the magnetic signal attributable to the movement of the reference vehicle;

a vehicle detection unit for calibrating a change in a magnetic signal attributable to movement of an actual vehicle, the magnetic signal being generated by the magnetic sensing unit, based on the calibration information generated by the calibration information generation unit, and detecting the movement of the actual vehicle by analyzing the calibrated change in the magnetic signal; and a control unit for controlling the communication unit, the calibration information generation unit and the vehicle detection unit, and setting mode to one of a calibration information generation mode for generating the calibration information and a vehicle detection mode for detecting the movement of the actual vehicle.

2. The vehicle detection apparatus using a magnetic sensor as set forth in claim 1, wherein, when the mode is set to the calibration information generation mode, the control unit transmits a reference vehicle movement request signal for requesting the reference vehicle to move, to the central management center via the communication unit.

3. The vehicle detection apparatus using a magnetic sensor as set forth in claim 2, wherein, when the change in the magnetic signal cannot be detected based on the movement of the reference vehicle, the control unit transmits a reference vehicle re-movement request signal for requesting the reference vehicle to re-move, to the central management center via the communication unit.

4. The vehicle detection apparatus using a magnetic sensor as set forth in claim 1, wherein, when the mode is set to vehicle detection mode and the vehicle detection unit detects the movement of the actual vehicle, the control unit transmits a vehicle detection signal to the central management center via the communication unit.

5. The vehicle detection apparatus using a magnetic sensor as set forth in claim 1, wherein the information about the movement of the reference vehicle includes any one of an ID of the reference vehicle, a speed of the reference vehicle, a travelling direction of the reference vehicle, whether the reference vehicle stops in the movement or not, and a time span of the movement of the reference vehicle.

6. The vehicle detection apparatus using a magnetic sensor as set forth in claim 1, wherein the vehicle detection unit performs calibration by performing filtering and size adjustment on the magnetic signal in such a way as to compare the change in the magnetic signal attributable to the movement of the actual vehicle with the change in the magnetic signal attributable to the movement of the reference vehicle, the change in the magnetic signal included in the calibration information.

7. The vehicle detection apparatus using a magnetic sensor as set forth in claim 1, further comprising a calibration information storage unit for storing the calibration information generated by the calibration information generation unit.

8. A vehicle detection method using a magnetic sensor, comprising:

detecting, by a magnetic sensing unit, a change in a magnetic signal attributable to movement of a reference vehicle;

receiving, by a communication unit, information about the movement of the reference vehicle from a central management center;

generating, by a calibration information generation unit, calibration information by using the information about the movement of the reference vehicle and the change in the magnetic signal attributable to the movement of the reference vehicle;

measuring, by the magnetic sensing unit, a change in a magnetic signal attributable to movement of an actual vehicle;

calibrating, by a vehicle detection unit, the change in the magnetic signal attributable to the movement of the actual vehicle based on the calibration information; and detecting the movement of the actual vehicle by analyzing the calibrated change in the magnetic signal.

9. The vehicle detection method using a magnetic sensor as set forth in claim 8, further comprising, before the detecting the change in the magnetic signal attributable to the movement of the reference vehicle, transmitting a reference vehicle movement request signal requesting the reference vehicle to move, to the central management center via the communication unit.

10. The vehicle detection method using a magnetic sensor as set forth in claim 8, further comprising, before receiving the information about the movement of the reference vehicle from the central management center, transmitting a reference vehicle re-movement request signal for requesting the reference vehicle to re-move, to the central management center via the communication unit when the change in the magnetic signal attributable to the movement of the reference vehicle cannot be detected.

11. The vehicle detection method using a magnetic sensor as set forth in claim 8, further comprising transmitting a vehicle detection signal to the central management center via the communication unit when the movement of the actual vehicle is detected.

12. The vehicle detection method using a magnetic sensor as set forth in claim 8, wherein the information about the movement of the reference vehicle comprises any one of an ID of the reference vehicle, a speed of the reference vehicle, a travelling direction of the reference vehicle, whether the reference vehicle stops in the movement or not, and a time span of the movement of the reference vehicle.

13. The vehicle detection method using a magnetic sensor as set forth in claim 8, wherein the calibrating the change in the magnetic signal based on the movement of the actual vehicle comprises performing calibration by performing filtering and size adjustment on the magnetic signal in such a way as to compare the change in the magnetic signal attributable to the movement of the actual vehicle with the change in the magnetic signal attributable to the movement of the reference vehicle, the change in the magnetic signal being included in the calibration information.

14. The vehicle detection method using a magnetic sensor as set forth in claim 8 further comprising storing the calibration information after generating the calibration information.

* * * * *